United States Patent [19]

Miciukiewicz

[11] Patent Number: 4,763,575

[45] Date of Patent: Aug. 16, 1988

[54] ENVELOPE PRESSURE PLATE FOR MAILING MACHINE

[75] Inventor: Joseph F. Miciukiewicz, Trumbull, Conn.

[73] Assignee: Pitney Bowes Inc., Stamford, Conn.

[21] Appl. No.: 35,553

[22] Filed: Apr. 6, 1987

[51] Int. Cl.[4] ..... B91F 13/20

[52] U.S. Cl. ..... 101/91; 101/235; 400/56; 271/274

[58] Field of Search ..... 400/56, 642, 645, 645.4; 101/91, 232–235; 271/274, 265

[56] References Cited

U.S. PATENT DOCUMENTS

| | | | |
|---|---|---|---|
| 735,814 | 8/1903 | Pitney et al. | 156/442.1 |
| 1,146,902 | 7/1915 | Schermack | 156/354 |
| 1,164,622 | 12/1915 | Anderson | 400/645.4 |
| 1,789,038 | 1/1931 | Friedrichs | 101/232 |
| 2,302,060 | 11/1942 | Ryan | 271/274 |
| 2,639,665 | 5/1953 | Lambert | 101/235 |
| 2,735,361 | 2/1956 | Ketler et al. | 101/235 |
| 2,933,038 | 4/1960 | Thut et al. | 101/234 |
| 2,974,951 | 3/1961 | Wilson et al. | 271/274 |
| 4,361,399 | 11/1982 | Sawada et al. | 271/274 |
| 4,437,780 | 3/1984 | Weber et al. | 400/642 |
| 4,620,807 | 11/1986 | Polit | 400/56 |
| 4,630,950 | 12/1986 | Chu et al. | 400/645 |

*Primary Examiner*—William Pieprz

*Attorney, Agent, or Firm*—Lawrence E Sklar; David E. Pitchenik; Melvin J. Scolnick

[57] ABSTRACT

A mailing machine for conveying envelopes seriatim along a feed path toward a postage meter operatively connected to said mailing machine. The mailing machine includes a housing frame, a deck secured to the frame for supporting the envelopes, the deck having a longitudinal slot therein, a lower, driven, feed roller rotatably mounted on the frame, and an electromechanical tripper mounted on the frame for actuating the postage meter, the tripper projecting upwardly through the deck slot adjacent and downstream of the lower feed roller. The mailing machine further includes a first shaft rotatably mounted on the frame perpendicular to the feed path, a second, pivotable shaft flexibly coupled at one end to an end of the first shaft, an upper feed roller rotatably mounted at the end portion of the second shaft remote from the first shaft, means for biasing the upper feed roller against the lower feed roller, a pair of slotted, translatable bushings, each of the bushings having an elongated slot extending substantially perpendicular to the deck, the slots slidingly engaging the second shaft, and a pressure plate having a pair of extensions on the upstream side secured to the translatable bushings and an aperture for receiving the electromechanical tripper, whereby the pressure plate may translate vertically and pivot laterally and longitudinally independently of the upper feed roller to thereby assure consistent actuation of the tripper for each envelope being conveyed to the postage meter regardless of the thickness or weight of the envelope.

7 Claims, 5 Drawing Sheets

ENVELOPE PRESSURE PLATE FOR MAILING MACHINE

BACKGROUND OF THE INVENTION

The instant invention relates to mailing machines, and more particularly to mailing machines having a tripper mechanism in the conveying deck for a postage meter separately connected thereto.

When a postage meter is attached or operatively connected to a mailing machine which feeds envelopes under a printing die in the postage meter, it is necessary that the mailing machine include a tripping mechanism for enabling the postage meter to initiate a printing cycle. Typically, the tripping mechanism is situated above the feeding deck of the mailing machine, and when envelopes of uniform or varying size and weight are fed seriatim through the mailing machine, no special problems are presented for actuation of the tripping mechanism.

However, it is desirable from a design standpoint to locate the tripping mechanism under the conveying deck of the mailing machine, but this location unfortunately poses special problems with respect to consistent, reliable actuation of the tripping mechanism. When envelopes of varying thickness and weight are being fed seriatim through the the mailing machine, it is possible, and happens frequently, that an envelope may not engage the tripping mechanism, but rather will pass over it. In such a case, the postage meter is not enabled and the envelope passes under the printing die of the postage meter without having postage printed thereon. Lighter weight or thinner envelopes would have the greater tendency to pass over and not engage the tripping mechanism. Thus, a device is required to maintain adequate pressure on any size or weight envelope to assure that it engages the tripping mechanism and does not pass over it.

Accordingly, the instant invention provides a pressure plate uniquely designed to accommodate envelopes of varying thickness and weight and which assures consistent actuation of the tripping mechanism located in the conveying deck of the mailing machine.

SUMMARY OF THE INVENTION

The instant invention provides a mailing machine for conveying envelopes seriatim along a feed path toward a postage meter operatively connected to said mailing machine, comprising: a housing frame; a deck secured to said frame for supporting said envelopes, said deck having a longitudinal slot therein; a lower, driven, feed roller rotatably mounted on said frame; an electro-mechanical tripper mounted on said frame for actuating said postage meter, said tripper projecting upwardly through the deck slot adjacent and downstream of said lower feed roller; a first shaft rotatably mounted on said frame perpendicular to said feed path; a second, pivotable shaft flexibly coupled at one end to an end of the first shaft; an upper feed roller rotatably mounted at the end portion of the second shaft remote from the first shaft; means for biasing said upper feed roller against said lower feed roller; a pair of slotted, translatable bushings, each of said bushings having an elongated slot extending substantially perpendicular to the deck, said slots slidingly engaging said second shaft; and a pressure plate having a pair of extensions on the upstream side secured to said translatable bushings and an aperture for receiving said electro-mechanical tripper, whereby said pressure plate may translate vertically and pivot laterally and longitudinally independently of said upper feed roller to thereby assure consistent actuation of said tripper for each envelope being conveyed to said postage meter regardless of the thickness or weight of the envelope.

DESCRIPTION OF THE PREFERRED EMBODIMENT

Figure 1:
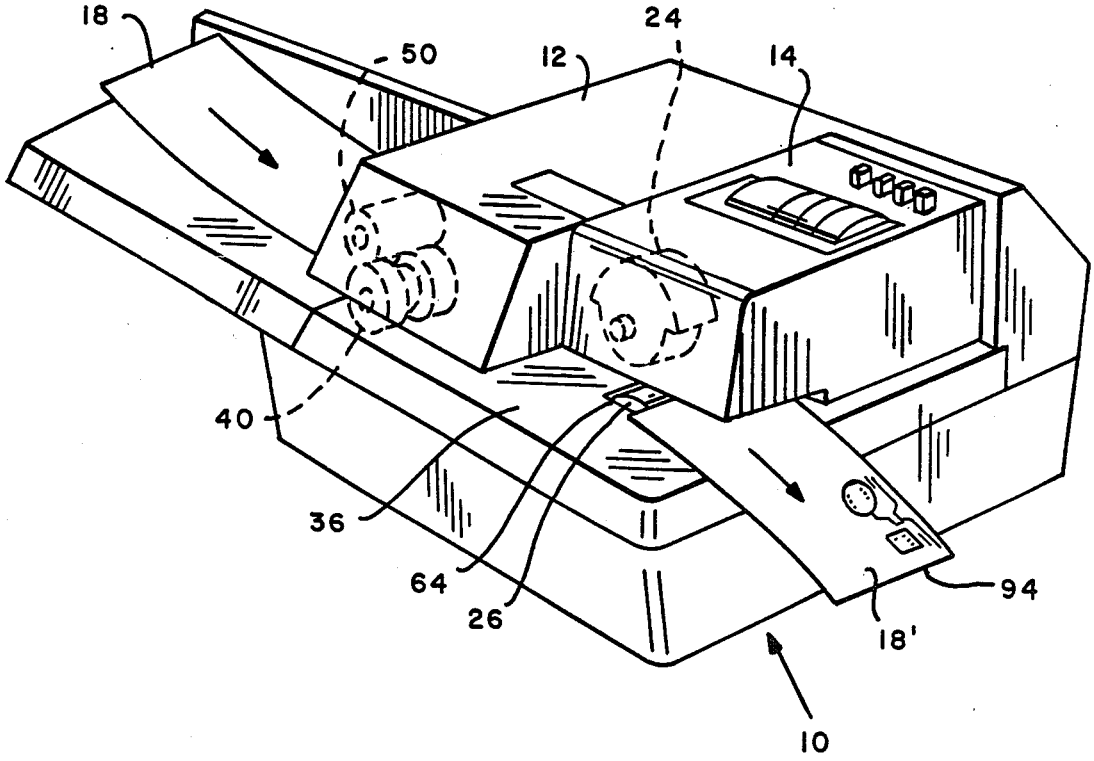
FIG. 1 is an isometric view of a mailing machine having a postage meter attached thereto.

Referring to FIG. 1, there is a mailing machine 10 shown, having a cover 12 and a postage meter 14 mounted thereon. A feed path is provided for stream feeding a series of envelopes 18 in succession from a supply of envelopes (not shown). An automatic feeding device may be used to feed the envelopes 18. It is also possible for a machine operator to rapidly and successively hand-feed envelopes 18 seriatim through the machine 10. A hand-fed envelope 18 is seen moving toward the postage meter 14 and there is seen inside the meter 14 a printing drum 24 which cooperates with an impression roller 26 (see FIG. 2) which helps to convey the metered envelope 18' away from the output end of the mailing machine 10.

Figure 2:
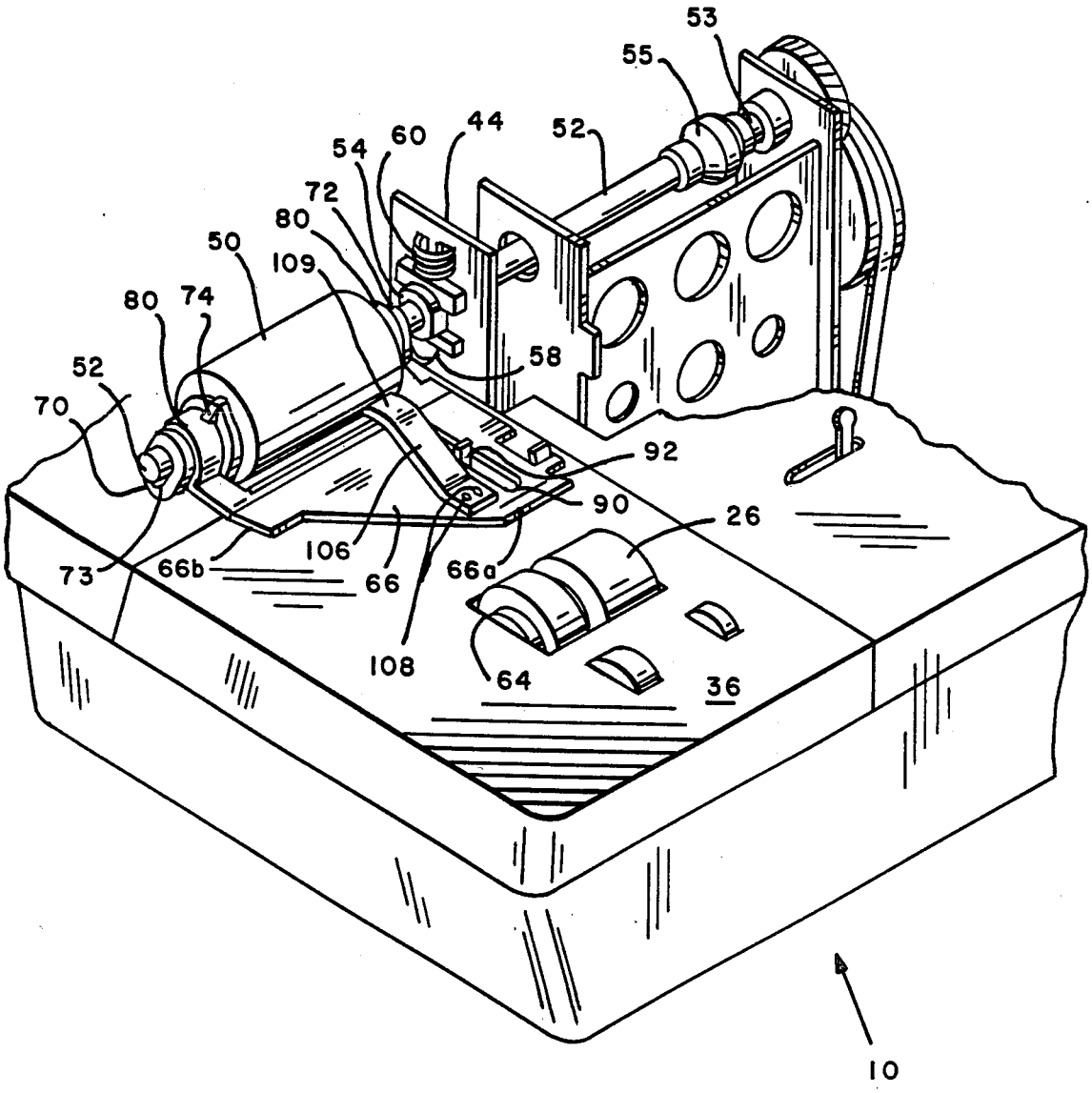
FIG. 2 is an isometric view of the mailing machine seen in FIG. 1 but with the postage meter and top cover of the mailing machine removed to show a pressure plate in accordance with the instant invention.

Referring to FIG. 2, the upper cover 12 and the postage meter 14 are removed, and the impression roller 26 is clearly seen, and will be understood by those skilled in the art to be operatively connected to a drive motor (not shown), which is located under a deck 36 of the mailing machine 10. Similarly, there is an operative drive connection to a lower input feed roller 40 (see FIGS. 4–8) which is rotatably journaled in the mailing machine 10. The feed roller 40 and the impression roller 26 are understood to be operatively connected to provide a rotatable machine cycle, each of which causes an imprint, or indicia on an envelope 18 being conveyed through the machine 10.

Continuing to refer to FIG. 2, there is an upper input feed roller 50 bonded to a shaft 52 which is rotatably supported by a bushing 54. There is a frame partition portion 44 having a slot 58 to receive the bushing 54 and which enables the shaft 52 and roller 50 to move upwardly against a bias spring 60 whenever an envelope 18 enters the nip defined between the lower roller 40 and the upper roller 50. The shaft 52 is connected to a second, driven, pivotable shaft 53, end to end, by a flexible coupling 55 (see FIG. 2).

The impression roller 26 is substantially covered by the deck 36, which also covers a major portion of the lower roller 40. An aperture 64 in the deck 36 exposes a suitable portion of the roller 26. A pressure plate 66 snaps over a pair of translatable, slotted bushings 70 and 72 having elongated slots 73 (see FIGS. 4–7) extending substantially perpendicular to the deck 36 which slidably mount on the shaft 52. The bushings 70 and 72 are fabricated of a suitable material for functioning as a bearing support for the pressure plate 66, which has a pair of curved extensions 80, defining inverted U-shaped slots 82 which snap over the bushings 70 and 72. A raised boss 74 on each of the bushings 70 and 72 has an undercut 76 under which the extensions 80 of the plate 66 snap. The result of the assembly of the pressure plate 66 to the bushings 70 and 72 is that the plate 66 is captured and located to enable lateral and longitudinal pivoting and vertical translation independent of the upper feed roller 50, thereby enabling the mailing machine 10 to process envelope of any thickness or shape including a wedge shape such as envelope **18*a*** seen in FIG. 8.

Figure 3:
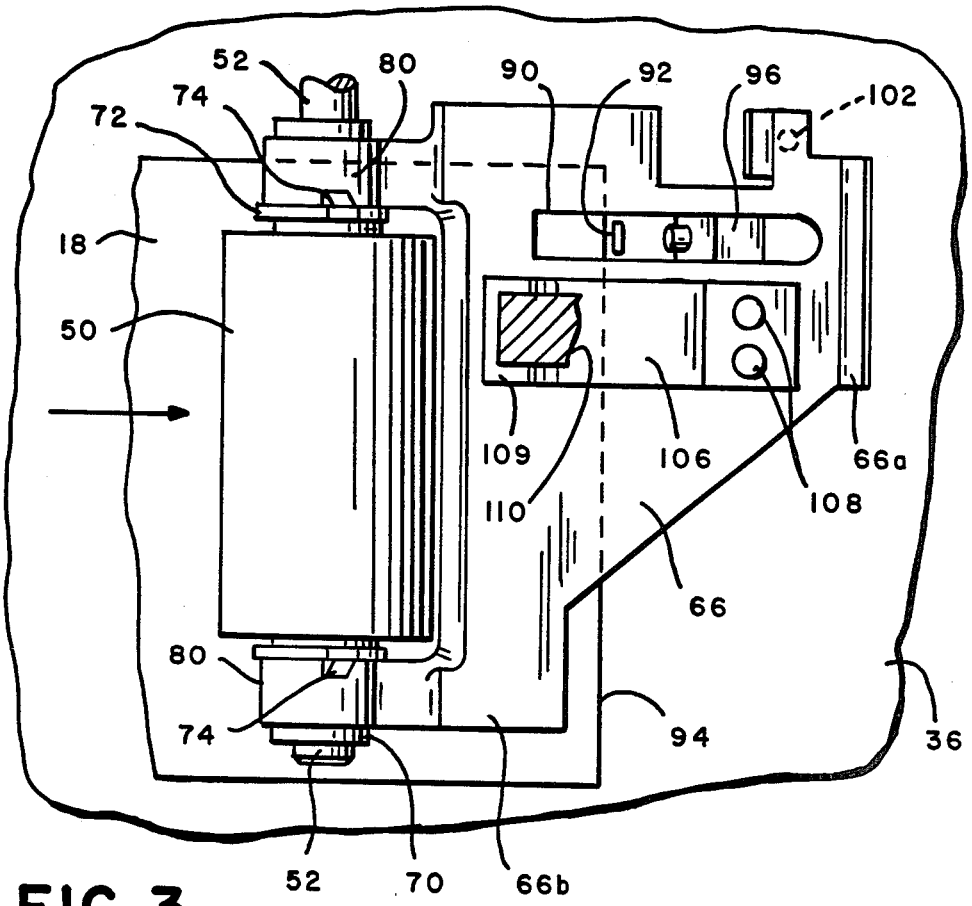
FIG. 3 is a top plan view of the mailing machine shown in FIG. 2.
Figure 4:
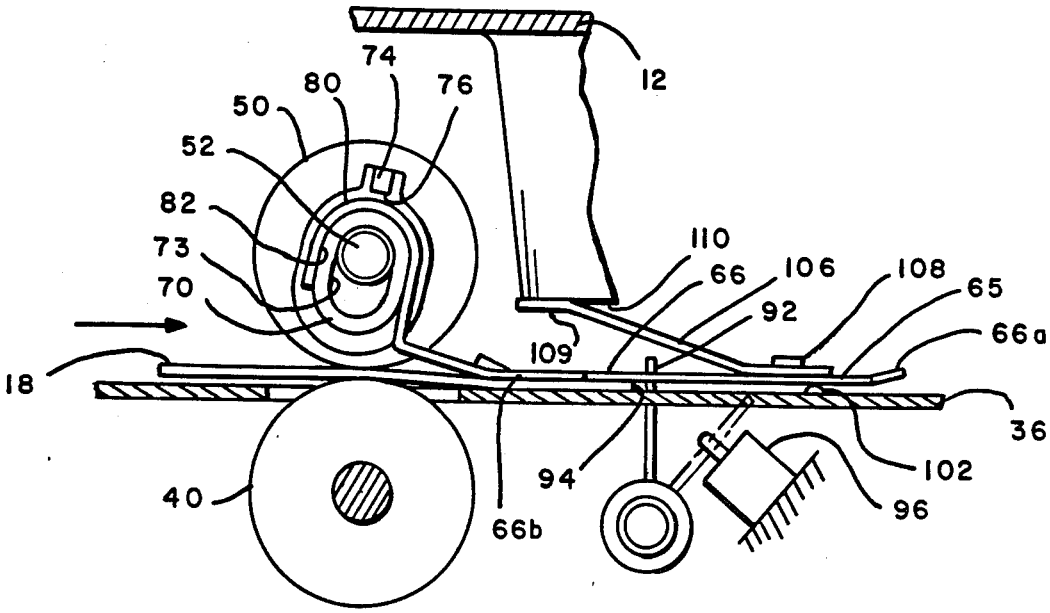
FIG. 4 is a side elevational view, partially broken away, of the mailing machine seen in FIG. 3, with the cover added, and showing a thin envelope about to engage the tripping mechanism.
Figure 5:
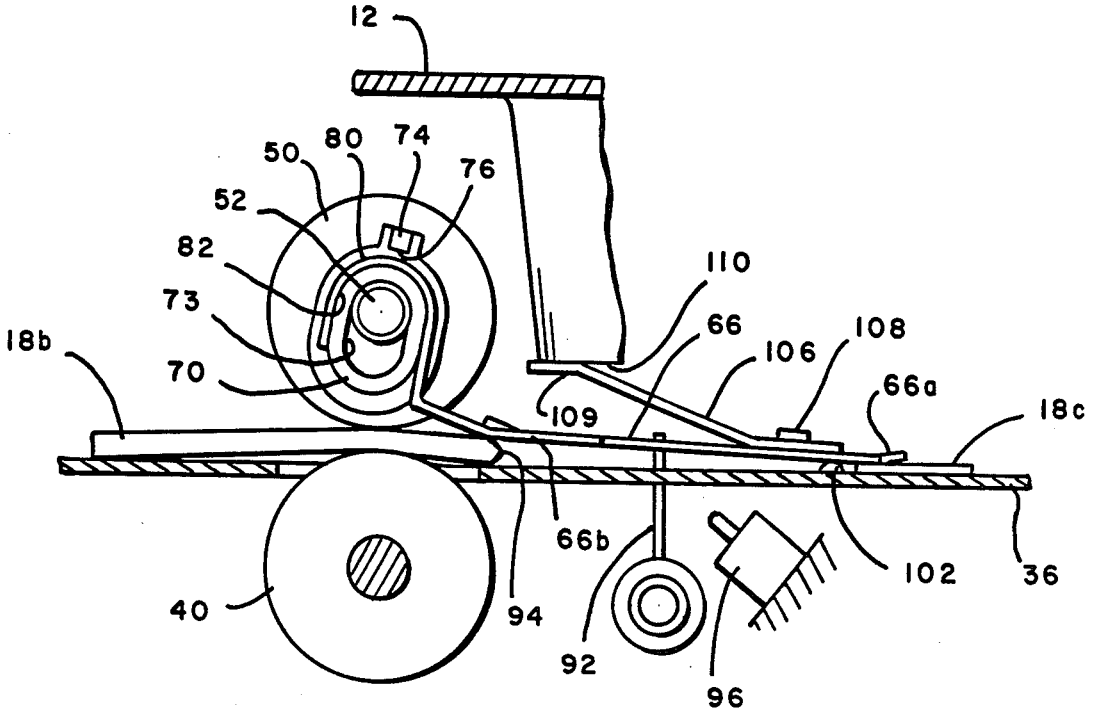
FIG. 5 is the same as FIG. 4 except that the trailing edge of the thin envelope is about to emerge from under the pressure plate and a thicker envelope is just beginning to engage the pressure plate.
Figure 6:
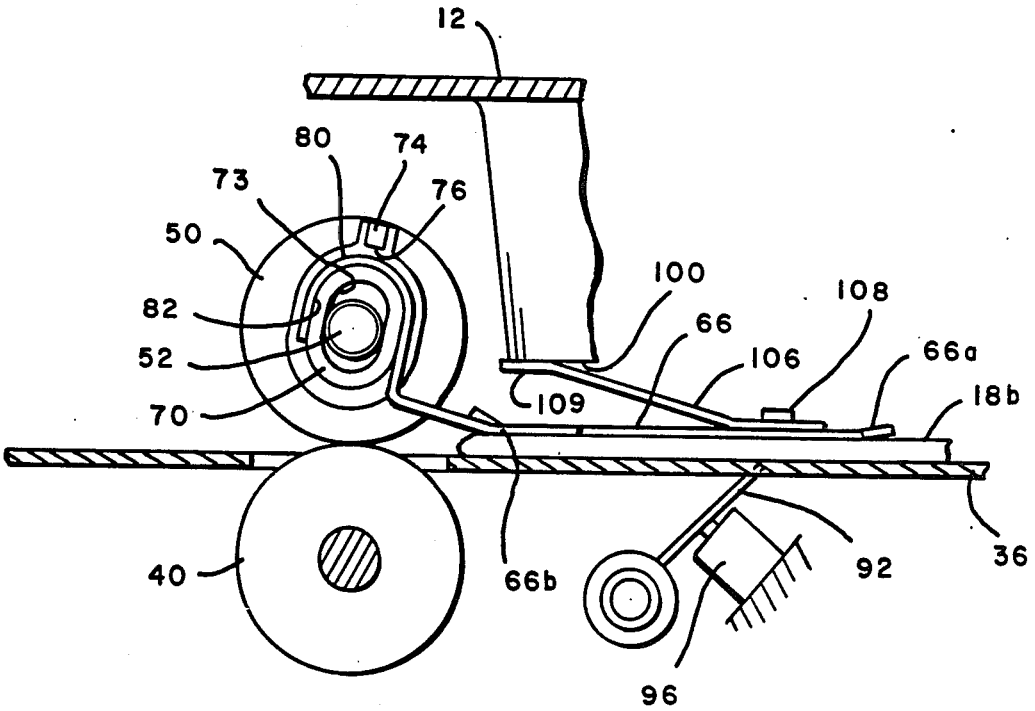
FIG. 6 is the same as FIG. 5 except that the thicker envelope is under the pressure plate and has just emerged from the nip of the feed rollers.
Figure 7:
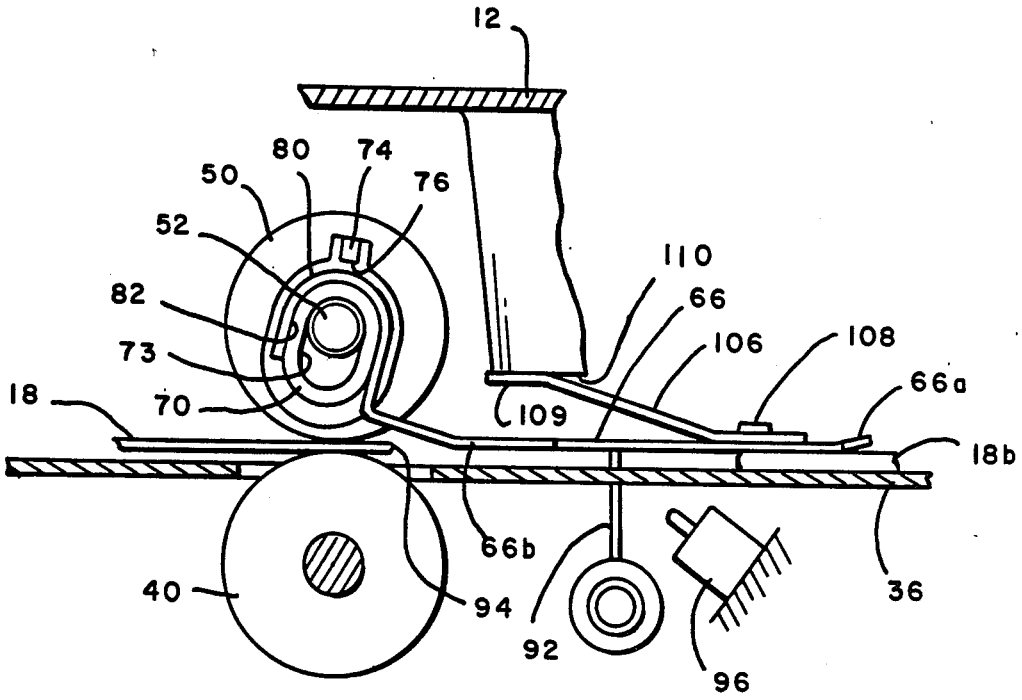
FIG. 7 is the same as FIG. 6 except that the thicker envelope is about to emerge from the pressure plate and a thinner envelope has just entered the nip of the feed rollers.

Referring now to FIGS. 2 and 3, the plate 66 is seen to include an elongated slot 90 oriented perpendicular to the shaft 52 and which receives an electro-mechanical tripper 92, which is pivotably mounted to the base of the mailing machine 10 under the deck 36. The tripper 92 is positioned to engage a leading end 94 of the envelope 18, and to then enable a switch 96, which causes a clutch (not shown) to be energized, thereby initiating a subsequent printing cycle through a drive system incorporating the driven shaft 53. The drive system is indirectly coupled to the printing drum 24 (see FIG. 1) and directly coupled to the lower feed roller 40 through a clutch (not shown). The drive system causes the impression roller 26 to cycle, and the printing drum 24 engages the envelope 18 to deposit the metered stamp thereon. In FIG. 6, the trip member 92 is shown rotated, being held down by a thick envelope **18*b* which is being driven over the member 92, while being guided and held down by the pressure plate 66. In FIG. 5, the thick envelope 18*b* is being conveyed through the rollers 40 and 50, while a thin envelope 18*c* has been advanced past the rollers 40 and 50 and is about to emerge from under the pressure plate 66 thereby enabling the tripper member 92 to be restored to the original upright position where a leading end 94 of the thick envelope 18*b* can engage the tripper member 92. At this time, a succeeding machine cycle is enabled wherein the thin envelope 18*c*** is printed upon.

Referring now to FIG. 2, there is a flat leaf spring 106 fastened to the plate 66 via a pair of rivets 108. The spring 106 is arranged to provide a resilient pressure against the plate 66 since an upper portion 109 of the spring 106 bears upon a surface 110 of the upper cover 12 of the mailing machine 10 (see FIGS. 4–7). The pressure applied to the plate 66 maintains control of the moving envelopes 18 so that they are forced downward and engage the tripper 92.

Figure 8:
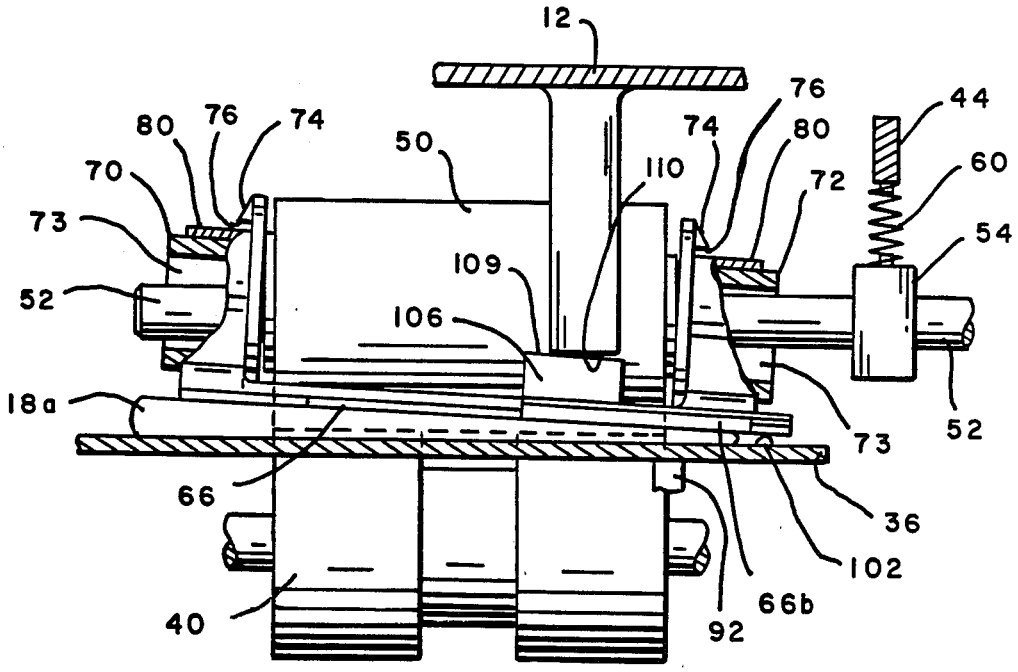
FIG. 8 is a front elevational view of the mailing machine seen in FIG. 1 showing the position of the top feed roller and pressure plate when an envelope having a thicker bottom than top has emerged from the feed rollers and is under the pressure plate; i.e. the envelope is in the same position as seen in FIG. 6.

Referring to FIG. 8, one special advantage of the pressure plate 66 is seen where a wedge-shaped envelope **18*a* is pressed against the deck 36. The plate 66 pivots laterally to accommodate the thicker end of the envelope 18*a* and also pivots longitudinally in the direction of the path of travel of the envelope 18*a* as it must to adapt to varying shapes of envelopes being fed through the conveying rollers 50 and 40. It can be seen by referring to FIGS. 5–7 that the plate 66 can accommodate a succession of a variety of envelopes; accordingly a downstream end 66*a* of the plate 66 is (see FIG. 5) bearing upon the thin envelope 18*c* and the thick envelope 18*b* has raised an upstream end 66*b* of the plate 66**, thereby maintaining pressure on each separate envelope.

In order for a very thin envelope to travel under the pressure plate 66 without being crumpled, a small post 102 is provided on the deck 36 out of the paper path. Thus, it is clear that the pressure plate 66 and mailing machine 10 can handle any envelope regardless of thickness and weight.

The exemplary embodiments described herein are presently considered to be preferred; however, it is contemplated that further variations and modification within the purview of those skilled in the art can be made herein. The following claims are intended to cover all such variations and modifications as fall within the true spirit and scope of the invention.

What is claimed is:

1. A mailing machine for conveying envelopes seriatim along a feed path toward a postage meter operatively connected to said mailing machine, comprising:

a housing frame;

a deck secured to said frame for supporting said envelopes, said deck having a longitudinal slot therein;

a lower, driven, feed roller rotatably mounted on said frame;

an electro-mechanical tripper mounted on said frame for actuating said postage meter, said tripper projecting upwardly through the deck slot adjacent and downstream of said lower feed roller;

a first shaft rotatably mounted on said frame perpendicular to said feed path;

a second, pivotable shaft flexibly coupled at one end to an end of the first shaft;

an upper feed roller rotatably mounted at the end portion of the second shaft remote from the first shaft;

means for biasing said upper feed roller against said lower feed roller;

a pair of slotted, translatable bushings, each of said bushings having an elongated slot extending substantially perpendicular to the deck, said slots slidingly engaging said second shaft;

a pressure plate having a pair of extensions on the upstream side secured to said translatable bushings and an aperture for receiving said electro-mechanical tripper, whereby said pressure plate may translate vertically and pivot laterally and longitudinally independently of the movement of said upper feed roller to thereby assure consistent actuation of said tripper for each envelope being conveyed to said postage meter regardless of the thickness or weight of the envelope.

2. The mailing machine of claim 1 wherein said first shaft is a driven shaft.

3. The mailing machine of claim 1 wherein said biasing means comprises a slidable bushing secured to said second shaft, said bushing slidingly engaging said housing frame, and a spring operatively connected to said slidable bushing and said housing frame.

4. The mailing machine of claim 3, additionally comprising means for maintaining a clearance between said pressure plate and said deck.

5. The mailing machine of claim 4, wherein said clearance maintaining means comprises a pimple situated on said deck out of the feed path for elevating said pressure plate.

6. The mailing machine of claim 4, additionally comprising means for biasing said pressure plate downward toward said deck.

7. The mailing machine of claim 6, wherein said downward biasing means comprises a spring secured to said pressure plate and engaging the top cover of said mailing machine.

* * * * *